US012085363B2

(12) United States Patent
Dalton

(10) Patent No.: US 12,085,363 B2
(45) Date of Patent: Sep. 10, 2024

(54) ARCHERY BOW SIGHT AND RELATED APPARATUSES

(71) Applicant: Hoyt Archery, Inc., Salt Lake City, UT (US)

(72) Inventor: Eliot D. Dalton, Erda, UT (US)

(73) Assignee: Hoyt Archery, Inc., Salt Lake City, UT (US)

( * ) Notice: Subject to any disclaimer, the term of this patent is extended or adjusted under 35 U.S.C. 154(b) by 27 days.

(21) Appl. No.: 17/985,363

(22) Filed: Nov. 11, 2022

(65) Prior Publication Data

US 2024/0159501 A1 May 16, 2024

(51) Int. Cl.
*F41G 1/467* (2006.01)

(52) U.S. Cl.
CPC ..... *F41G 1/467* (2013.01)

(58) Field of Classification Search
CPC ... F41G 1/467; F41G 1/14; F41G 1/42; F41G 1/44; F41G 1/46
USPC ..... 124/87
See application file for complete search history.

(56) References Cited

U.S. PATENT DOCUMENTS 5,228,204 A * 7/1993 Khoshnood ..... F41G 1/467 124/87
5,685,081 A * 11/1997 Winegar ..... F41G 1/467 42/132
6,725,854 B1 * 4/2004 Afshari ..... F41G 1/345 42/145
6,745,482 B1 * 6/2004 Mallozzi ..... F41G 1/467 33/265
8,176,644 B1 * 5/2012 Summers ..... F41G 1/467 124/87
8,839,525 B2 * 9/2014 Pulkrabek ..... F41G 1/467 124/87
9,644,921 B1 * 5/2017 LoRocco ..... F41G 1/467
2003/0110647 A1 * 6/2003 Henry ..... F41G 1/467 124/87
2007/0028467 A1 * 2/2007 Bradley ..... F41G 1/467 33/265
2011/0271535 A1 * 11/2011 Varner ..... F41G 1/467 33/265
2012/0325194 A1 * 12/2012 LoRocco ..... F41G 1/467 124/87
2013/0242593 A1 * 9/2013 LoRocco ..... F41G 1/345 362/418
2014/0130786 A1 * 5/2014 Hall ..... F41B 5/1403 124/87
2016/0169622 A1 * 6/2016 Graziano ..... F41G 1/467 124/87
2017/0363389 A1 * 12/2017 Lohan ..... F41G 1/467

* cited by examiner

*Primary Examiner* — John E Simms, Jr.

(57) ABSTRACT

An archery bow sight can include a housing, one or more pins, and a level indicator. In some examples, the housing has a first section that defines a radius of curvature. A second section of the housing can be disposed closer to a center of the curvature than the first section. In some examples, a first section of the housing can define a projected shape and a minimum distance between a second section and the center of the projected shape can be less than a radius of the projected shape. In some examples, the housing can include first and second lateral sections having respective distal ends that are displaced from one another.

19 Claims, 9 Drawing Sheets

ARCHERY BOW SIGHT AND RELATED APPARATUSES

TECHNICAL FIELD

The present disclosure generally relates to archery equipment and specifically relates to archery bow sights.

BACKGROUND

Bowhunters and other archers use finely tuned archery equipment to launch arrows and other projectiles down range at one or more targets. This archery equipment can include an archery bow and one or more archery accessories, such as, one or more stabilizers, an arrow rest, a sight, a quiver, a combination thereof, or other archery accessories.

An archery bow sight can enable an archer to predict an area in which the projectile impact the target. This predictability can increase the accuracy of the archer's shot placement and enable the archer to shoot targets at varying distances and angles relative to the archer. Indeed, archery bow sights can include features which directly influence the archer's ability to predictably and accurately launch arrows at one or more targets within an environment. There is a need for novel archery bow sight features which improve or increase the archer's ability to accurately and predictably launch projectiles downrange at various distances from the archer. For example, there remains a need for increasing a maximum distance the archer can aim at a target downrange using an archery bow sight.

SUMMARY

One aspect of the present disclosure relates to a sight for an archery bow. The sight includes a housing, a pin, and a level indicator. The housing has a first section and a second section. The first section defines a constant curvature about a radius and a center. The center defines an axis intersecting the center. The radius is at least 1.5 times greater than a minimum distance from the second section to the axis. The pin is disposed within the housing. The level indicator is coupled to the housing.

In some examples, a cross-section of the first section can define a semicircle. In some examples, the a portion of the second section can extend toward the axis. The portion of the second section that extends toward the axis can be disposed nearer to the pin than the first section. In some examples, the radius can be at least 2 times greater than the minimum distance from the second section to the axis. In some examples, the first section and the second section can be integrally formed. In some examples, the pin can be coupled to a member coupled to the second section. In some examples, the pin is coupled to the second section.

Another aspect of the disclosure relates to a sight for an archery bow. The sight includes a housing, a pin, and a level indicator. The housing includes a first section and a second section. The first section defines a projected shape having three tangent points on the first section. The projected shape has a constant radius and defines a center. The projected shape can intersect the second section. A central axis extends axially through the center. A minimum distance from the first section to the central axis is at least 1.5 times greater than a minimum distance from the second section to the central axis. The pin is disposed within the housing. The level indicator is coupled to the housing.

In some examples, the central axis can be defined equidistant from the respective lateral inner surfaces of the first section. In some examples, the minimum distance from the first section to the central axis can be at least 2 times greater than the minimum distance from the second section to the central axis. In some examples, the central axis van be disposed nearer to the level indicator than the first section. In some examples, the first section can have a semi-circular cross-sectional shape.

Yet another aspect of the present disclosure relates to a sight for an archery bow. The sight includes a housing, a pin, and a level indicator. The housing includes a first lateral section and a second lateral section. The first lateral section has a first distal end. The second lateral section has a second distal end. The first distal end is displaced a distance from the second distal end. The pin is disposed within the housing. The level indicator is coupled to the housing.

In some examples, the housing further includes an intermediate section coupled to a first proximal end of the first lateral section and a second proximal end of the second lateral section. In some examples, the level indicator can be coupled to the intermediate section. In some examples, at least one of the first distal end and the second distal end can be free-floating. In some examples, the first lateral section, the second lateral section, and the intermediate section can be integrally formed. In some examples, the pin can be disposed on a member extending from the housing. In some examples, the sight can also include a transparent lens coupled to the housing. The pin can be disposed on the transparent lens. In some examples, the housing can define a central axis. The central axis can intersect the pin.

The above summary of the present invention is not intended to describe each embodiment or every implementation of the present invention. The Figures and the detailed description that follow more particularly exemplify one or more preferred embodiments.

BRIEF DESCRIPTION OF THE DRAWINGS

The accompanying drawings and figures illustrate a number of exemplary embodiments and are part of the specification. Together with the present description, these drawings demonstrate and explain various principles of this disclosure. A further understanding of the nature and advantages of the present invention may be realized by reference to the following drawings. In the appended figures, similar components or features may have the same reference label.

Figure 1A:
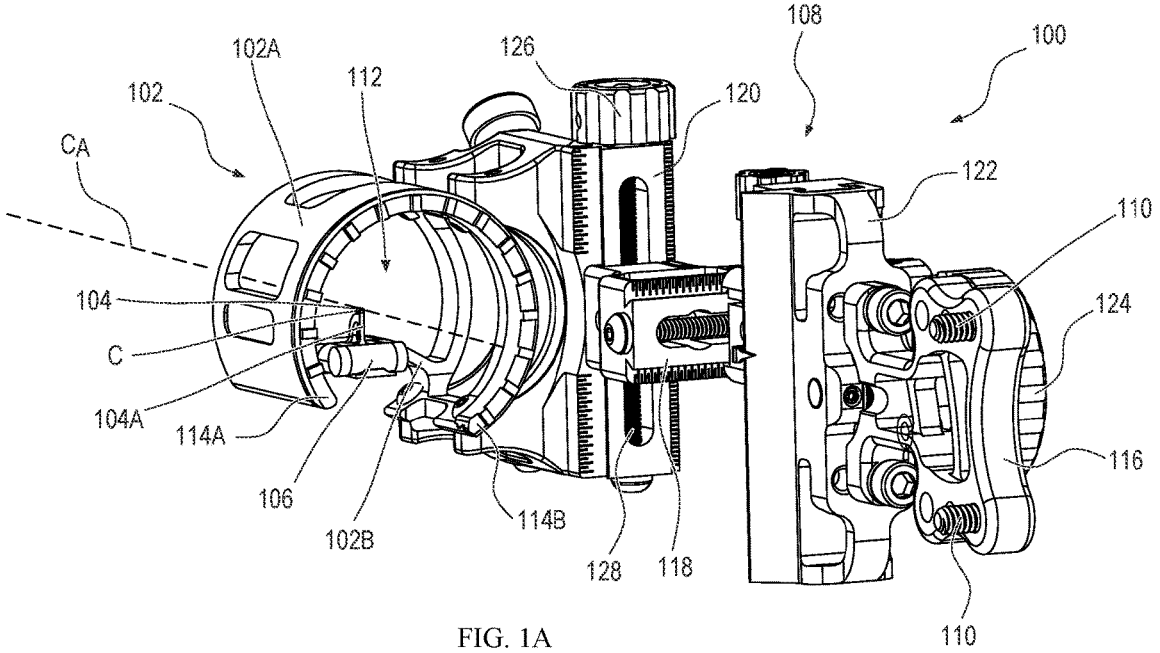
FIG. 1A is a perspective side view of an archery bow sight, according to some embodiments.

While the embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION

Aspects of the present disclosure generally relate to archery bow sights having one or more features enabling an archer to attain a greater maximum distance for accurately and predictably launching projectiles into a target downrange. Archery bow sights have one or more pins that can be correlated to a specific distance the projectile will travel. Additionally, or alternatively, the housing can be adjustable (e.g., vertically) such that one or more pins are displaced (e.g., vertically). For example, the housing and or pins can be vertically displaced downward such that the archer is required to rotate or tilt the archery bow (and the arrow) at a greater angle to place the pin on the target. An archery bow held at a greater angle can increase the distance the arrow will travel. However, despite the archery bow being capable of launching a projectile greater distances, the size and shape of traditional archery sight housings limit vertical displacement of the housing and therefore limit the archer's range. For example, lowering or displacing the housing can place a portion of the housing within a path the arrow travels. Thereby causing a portion of the arrow (e.g., arrow vanes) to contact the housing as the arrow is launched from the archery bow. Contact between the arrow and the housing can significantly decrease the travel of the arrow and negatively impact accurate shot placement.

According to aspects of the present disclosure, the archery bow sight can include a housing sized and shaped to be adjustable within a closer proximity to a path the projectile is launched from the archery bow without coming into contact with the projectile. This reduced or optimized proximity between the housing and the path of the projectile can enable the archery bow sight to be used by the archer to aim at targets that are a greater distance than traditional housing s accommodate. In other words, aspects of the present disclosure increase the range or distance the archery bow sight can be used to aim at a target.

In some examples, an archery bow sight can include a housing having a first section defining a constant curvature about a radius and a center. The center defines an axis extending axially or longitudinally through the housing and intersecting the center. The housing includes a second section. The radius is greater than a minimum distance from the second section to the axis. For example, the minimum distance from the second section to the axis can be 1 centimeter (cm) and the radius can be 2 cm. In some examples, the radius is at least 1.5 times greater than the minimum distance from the second section to the axis. In some examples, the radius is at least 2 times greater than the minimum distance from the axis to the second section. The increased ratio between the radius and the minimum distance from the second section to the axis can enable the housing to be adjusted closer to the path the arrow travels when launched and thereby enables the archer to garner additional aiming distance from the archery bow sight.

In some examples, an archery bow sight can include a housing having a first section defining a projected shape having three tangent points on the first section. The projected shape can have a constant radius of curvature defining a center of the projected shape. The projected shape can intersect the second section. A central axis can extend axially or longitudinally through the center. For example, the first section can at least partially define a sight window and the central axis can extend through the sight window. The housing includes a second section. A minimum distance from the first section to the central axis is greater than a minimum distance from the second section to the central axis. For example, the minimum distance from the central axis and the first section can be 2 cm and the minimum distance from the second section to the central axis can be 0.5 cm. In some examples, the minimum distance between the central axis and the first section is at least 1.5 times greater than the minimum distance between the central axis and the second section. In some examples, the minimum distance between the central axis and the first section is at least 2 times greater than the minimum distance between the central axis and the second section.

In some examples, an archery bow sight can include a housing having a first lateral section and a second lateral section. The first and second lateral sections can each have respective distal ends and proximal ends. The distal end of the first lateral section is displaced a distance from the distal end of the second lateral section. In other words, the respective distal ends are spaced apart to enable a projectile (e.g., an arrow) to pass within a proximity of a pin within the housing without contacting the housing itself. In some examples the housing can include an intermediate section disposed between the first and second lateral sections. For example, the intermediate section can be coupled to the respective proximal ends of the first and second lateral sections. In some examples, the first and second lateral sections can be integrally formed from a singular piece of material.

The present description provides examples, and is not limiting of the scope, applicability, or configuration set forth in the claims. Thus, it will be understood that changes may be made in the function and arrangement of the housing, pin(s), members, support structure(s), a level indicator, combinations thereof, and/or other elements of the archery bow sights discussed without departing from the spirit and scope of the disclosure, and various embodiments may omit, substitute, or add other procedures or components as appropriate. For instance, features described with respect to certain embodiments may be combined in other embodiments.

Figure 1B:
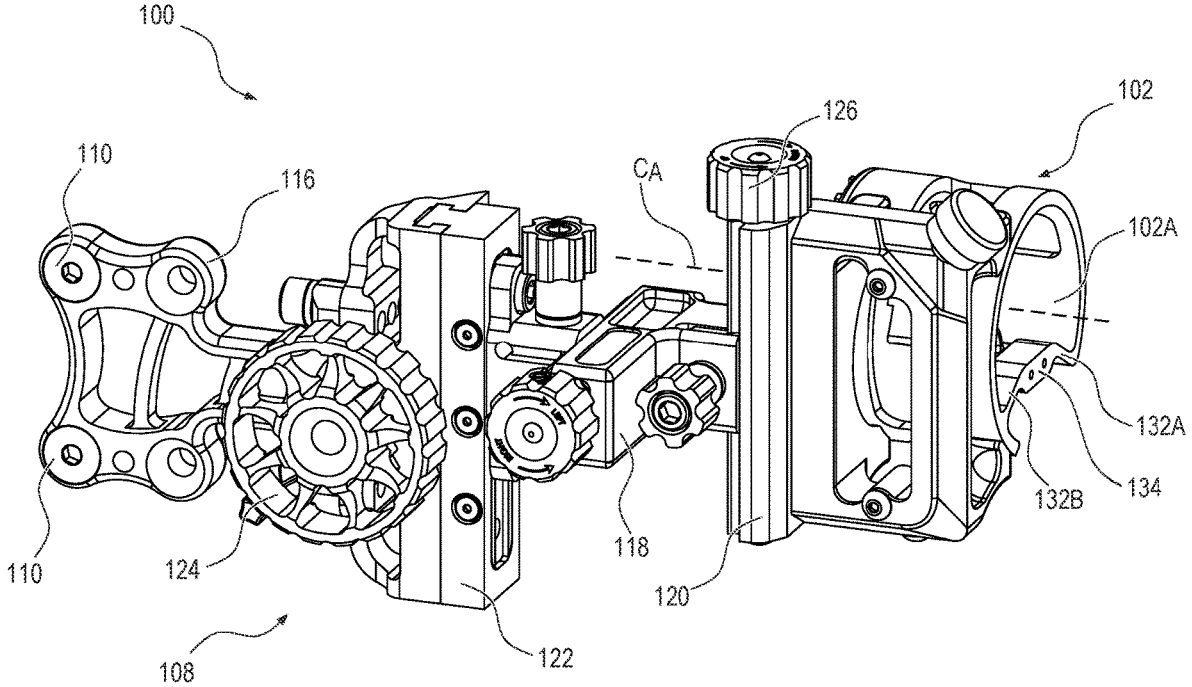
FIG. 1B is a perspective side view of the archery bow sight, according to some embodiments.
Figure 1C:
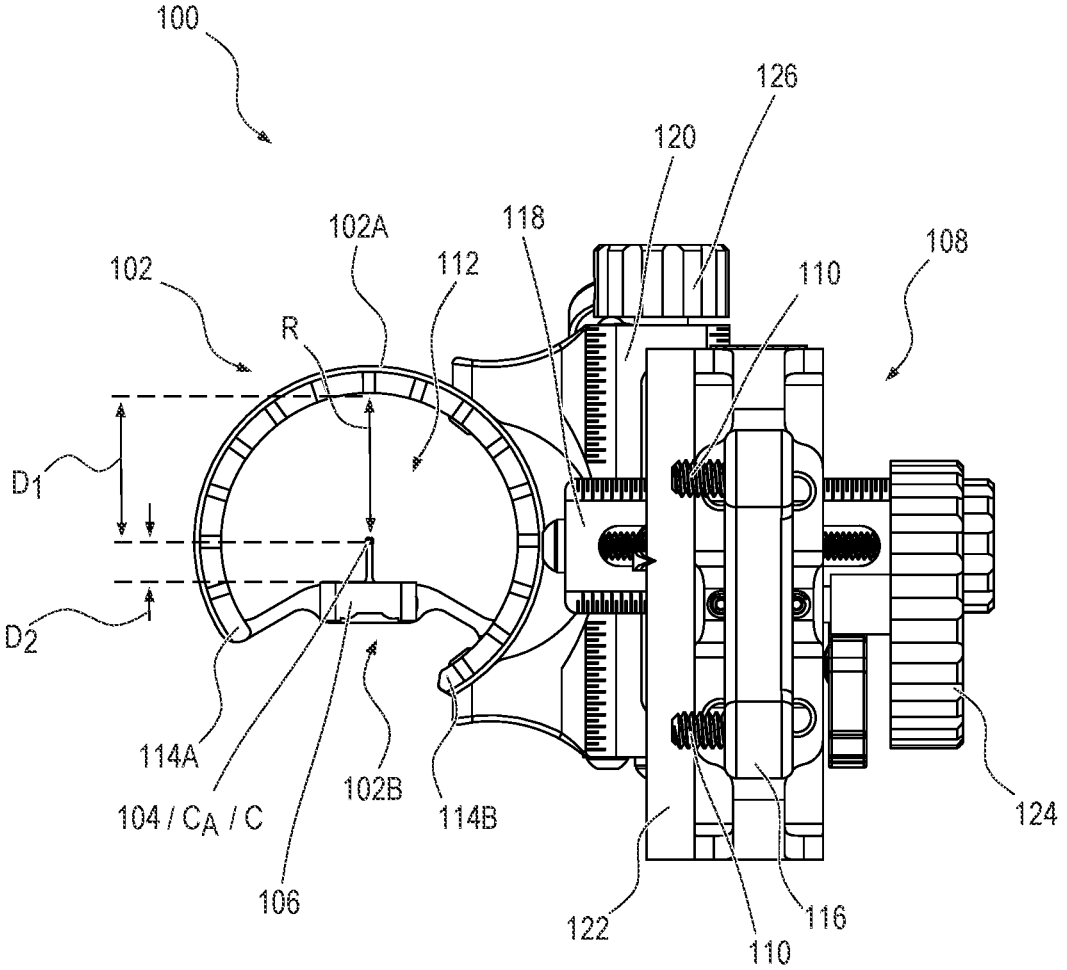
FIG. 1C is a rear view of the archery bow sight, according to some embodiments.

Referring now to the figures in detail, FIGS. 1A-1C show respective views of an archery bow sight 100 including a housing 102, one or more pins 104, a level indicator 106, and a support structure 108. The sight 100 can be coupled to an archery bow, for example, by coupling the sight 100 to a riser of an archery bow via fasteners 110. In some examples, the support structure 108 can include one or more components configured to mount to a picatinny rail.

The particular sight 100 depicted in FIGS. 1A-1E is referred to as a slider or mover sight due to the ability of the archer to vertically move or adjust the housing 102 to reposition the one or more pins 104 to correlate with a particular distance between the archer and the target. When aiming at a target, the archer can pull a bowstring of the archery bow to a fully drawn state. Thereafter, the archer can look through a peep sight and align the housing 102 with the inner diameter of the peep sight and level the sight using the level indicator 106. Thereafter, the pin 104 can be positioned on the target and the archer can release the bowstring to launch a projectile at the target.

In some examples, the total vertical displacement or adjustment of the housing 102 relative to one or more components of the support structure 108 can be determinative of a total or maximum distance the archer can use the sight 100 to aim at a target. That is, the further the pin 104 and/or housing 102 can be lowered (i.e., moved toward or proximally set near an arrow on an arrow rest), the greater the distance the pin 104 can be used to aim at a target. Aspects of the present disclosure relate to housings which enable a greater maximum aimable distance using the archery bow sight.

In some examples, the housing 102 can include a first section 102A and a second section 102B. The first section 102A and the second section 102B can be integrally formed in some examples. In other words, the first section 102A and the second section 102B can be molded or machined from a single piece of material. In some examples, the first section 102A can be coupled to the second section 102B, for example, by one or more fasteners, adhesives, welds, a combination thereof, or any other coupling mechanism. The first section 102A can form a cavity or volume 112 at least partially surrounding the one or more pins 104. In some examples, the first section 102A can include first and second distal ends 114A, 114B gapped or separated from one another by a distance.

In some examples, the second section 102B can partially define the volume 112. The second section 102B can act as a support for the pin 104 and/or the level indicator 106. For example, the level indicator 106 can be fastened, adhered, a combination thereof, or otherwise coupled to the second section 102B. In some examples, the pin 104 can include a pin support 104A retaining a fiberoptic element. In other examples, the pin 104 can be an indicia (e.g., a printed or etched dot) disposed on a transparent lens (not shown) coupled to the housing 102 within the volume 112. In some examples, the second section 102B can be disposed between at least a portion of the first section 102A and a projectile (see arrow 130 at FIGS. 1D and 1E) when the sight 100 is coupled to an archery bow.

In some examples, the second section 102B can include one or more members 132A-132B extending from the first section 102A and coupled to a base 134 supporting the one or more pins 104 and the level indicator 106. The members 132A-132B can be arranged to enable the housing 102 to be disposed near an arrow 130 (see gap $G_2$ at FIG. 1E). More specifically, the members 132A-132B can be arranged such that the housing 102 can be disposed near an arrow shaft 136 of the arrow 130 and also provides clearance for one or more vanes 138 of the arrow 130. For example, each of the one or more members 132A-132B can be angled (see angle $A_1$ at FIG. 1E) relative to the base 134. The angle $A_1$ can be at least 90 degrees, between about 90 degrees and about 135 degrees, between about 135 degrees and about 180 degrees, between about 180 degrees and about 225 degrees, or greater than 225 degrees.

In some examples, at least a portion of the first section 102A can have a constant curvature (e.g., constant radius of curvature) defining a radius R to a center C of the of curvature (e.g., the focus of the curvature). In some examples, a pin (e.g., the one or more pins 104) can be disposed at the center C (e.g., disposed the radius R from the first section 102A). Additionally, or alternatively, one or more pins (e.g., the one or more pins 104) can be disposed below the center C (e.g., disposed further from the first section 102A than the radius R). Additionally, or alternatively, one or more pins (e.g., the one or more pins 104) can be disposed above the center C (e.g., disposed nearer the first section 102A than the radius R). The center C can define a central axis $C_A$ extending through volume 112. In other words, the first section 102A can define the central axis $C_A$ intersecting and extending along the center C.

As shown in FIG. 1C the first section 102A can be disposed a minimum distance $D_1$ from the central axis $C_A$ (i.e., the radius R). The second section 102B can be disposed a minimum distance $D_2$ from the central axis $C_A$. The minimum distance $D_1$ is greater than the minimum distance $D_2$. For example, the minimum distance $D_1$ can be 1.5 times greater than the minimum distance $D_2$. In some examples, the minimum distance $D_1$ and the minimum distance $D_2$ can form a ratio of less than 1.25 to 1, between about 1.25 to 1 and about 1.5 to 1, between about 1.5 to 1 and about 1.75 to 1, between about 1.75 to 1 and about 2 to 1, between about 2 to 1 and about 2.25 to 1, between about 2.25 to 1 and about 2.5 to 1, or greater than 2.5 to 1. While the pin 104 and the center C of the curvature of the first section 102A are shown as aligned or substantially aligned in FIG. 1C, the pin 104 may not be aligned with the center C in some examples. In other words, the pin 104 may not be disposed the radius R from the first section 102A in some examples. Instead, the pin 104 can be disposed a distance greater than or less than the radius R from the first section 102A in some examples.

The support structure 108 can include any component or feature configured to couple the sight 100 to an archery bow and enabling adjustment of one or more components of the sight 100. For example, the support structure 108 can include a mounting block 116, a windage block 118, and an elevation block 120. In some examples, the mounting block 116 can include an adjustment block and an actuator enabling the archer to translate one or more of the windage block 118, the elevation block 120, and the housing 102. For example, the mounting block 116 can include an adjustment block 122 and a wheel 124 or other actuator. The wheel 124 can be rotated to translate the windage block 118, the elevation block 120, and the housing 102 along a vertical axis. Additionally, or alternatively, the elevation block 120 and housing 102 can be vertically translated relative to the windage block 102 to raise or lower the housing 102.

The particular sight 100 depicted in FIGS. 1A-1E is referred to as a slider or mover sight due to the ability of the archer to vertically move or adjust the housing 102 to reposition the one or more pins 104 to correlate with a particular distance between the archer and the target. For example, the archer can rotate the wheel 124 or other adjustment mechanism to vertically reposition the housing 102 (and the pin 104) relative to one or more components of the support structure 108. Other examples of sights may not include an adjustment mechanism (e.g., the wheel 124), but may allow the elevation block 120 to be vertically translated relative to the windage block 102 to raise or lower the housing 102. For example, the archer may rotate a knob 126 which causes the windage block 118 to translate relative to a threaded member 128 disposed within or adjacent the elevation block 120.

Figure 1D:
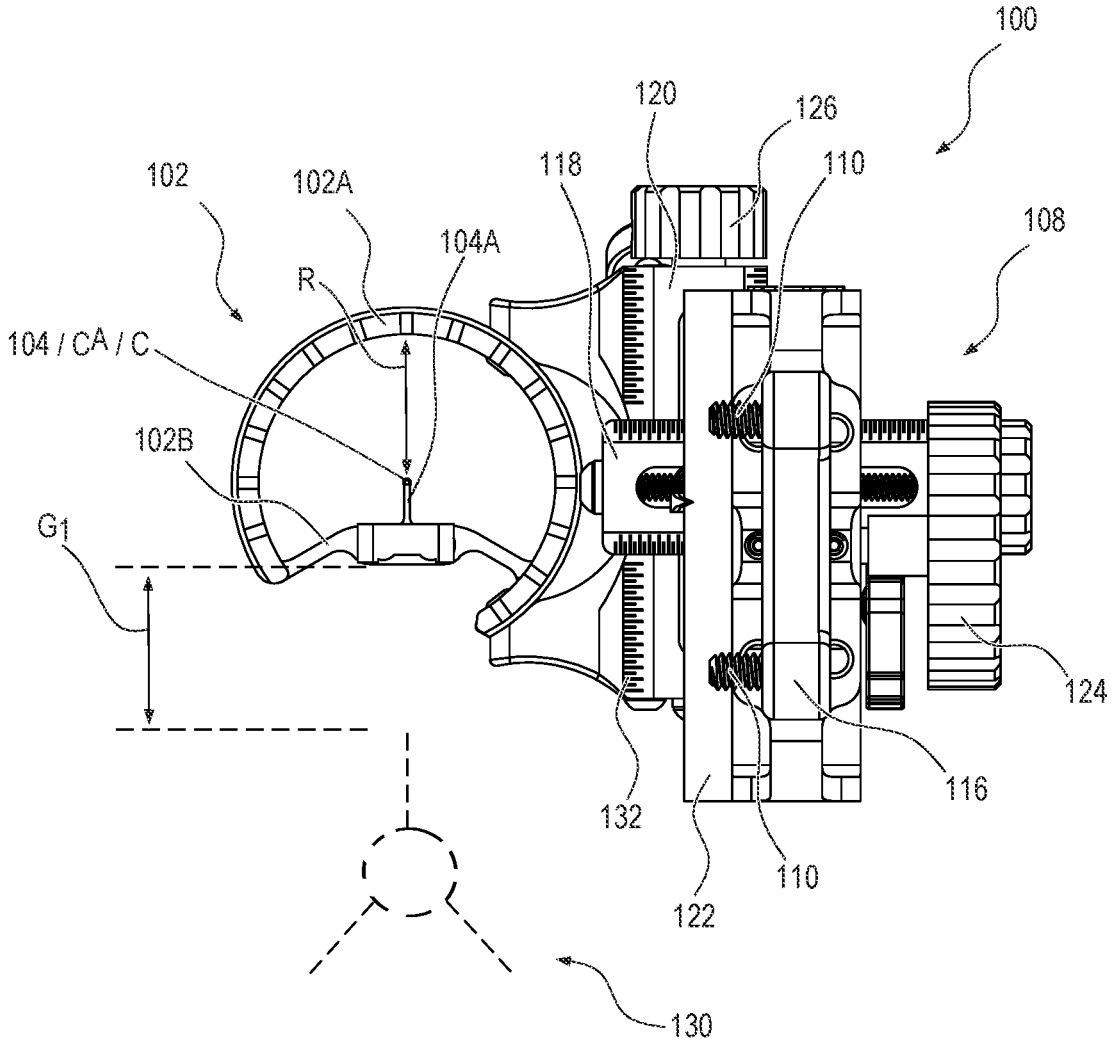
FIG. 1D is a rear view of the archery bow sight in a first configuration, according to some embodiments.
Figure 1E:
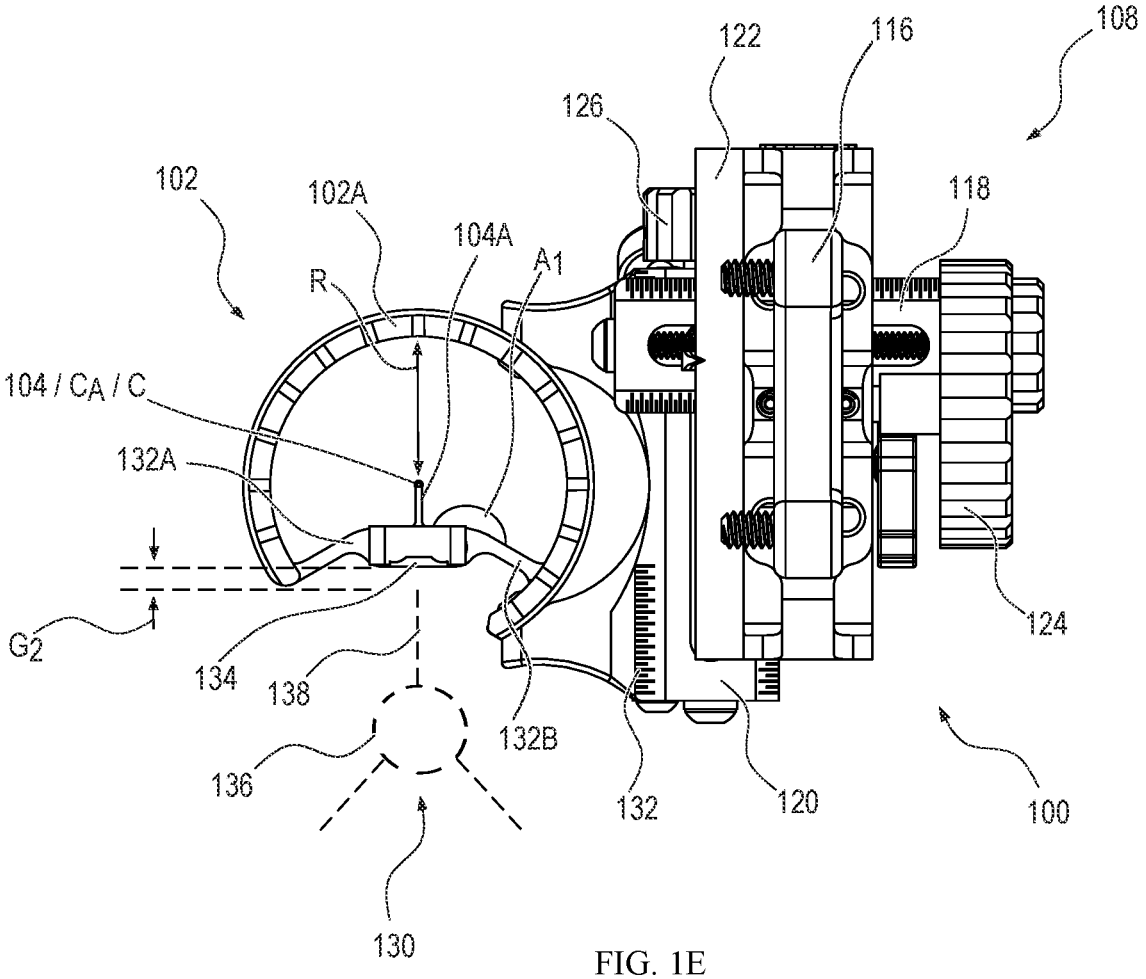
FIG. 1E is a rear view of the archery bow sight in a second configuration, according to some embodiments.

FIG. 1D shows the sight 100 in a first configuration in which the housing 102 is arranged in a first spacing or gap $G_1$ from an arrow 130. More specifically, FIG. 1D shows the windage block 118 disposed centrally relative to the elevation block 120 (see indicia 132 on elevation block 120). FIG. 1E shows the sight 100 in a second configuration wherein the housing 102 is arranged in a second spacing or gap $G_2$ from the arrow 130. More specifically, FIG. 1E shows the windage block 118 coupled to the elevation block 120 at a relatively higher position on the elevation block 120 (see indicia 132 on elevation block 120) such that the housing 102 and the elevation block 120 are retained relatively closer to the arrow 130 than the first configuration shown in FIG. 1D. While FIGS. 1D and 1E illustrate the elevation block 120 being adjusted relative to the windage block 118, other examples can additionally, or alternatively, alter the position of the housing 102 relative to the arrow 130 by manipulating the adjustment block 122 via the wheel 124. Any adjustment mechanism for any archery bow sight that is now known, or otherwise discovered, should be read within the purview of the present disclosure.

The housing 102 is sized and shaped to enable the pin 104 to be adjustable within a closer proximity to a path the arrow 130 is launched from the archery bow without coming into contact with the arrow 130. For example, as shown in FIGS. 1A-1E, the second section 102B of the housing 102 can be disposed closer to the center axis $C_A$ than the first section 102A to reduce a footprint of the housing 102 that may contact the arrow 130. This reduced or optimized footprint can lessen the proximity between the housing 102 and the path of the arrow 130 and can thereby enable the archery bow sight 100 to be used by the archer to aim at targets that are a greater distance than traditional housing accommodate. In other words, the shape and size of the first and second sections 102A, 102B of the housing 102 can increase the range or distance the archery bow sight 100 can be used to aim at a target because the pin 104 can be moved or translated closer to the arrow 130. That is, the ratio between the minimum distance $D_1$ and the minimum distance $D_2$, described herein with reference to FIG. 1C, can enable the housing 102 to be adjusted closer to the path the arrow 130 travels when launched. This positions the pin 104 closer to the arrow 130 and thereby enables the archer to garner additional aiming distance from the archery bow sight 100.

Figure 2A:
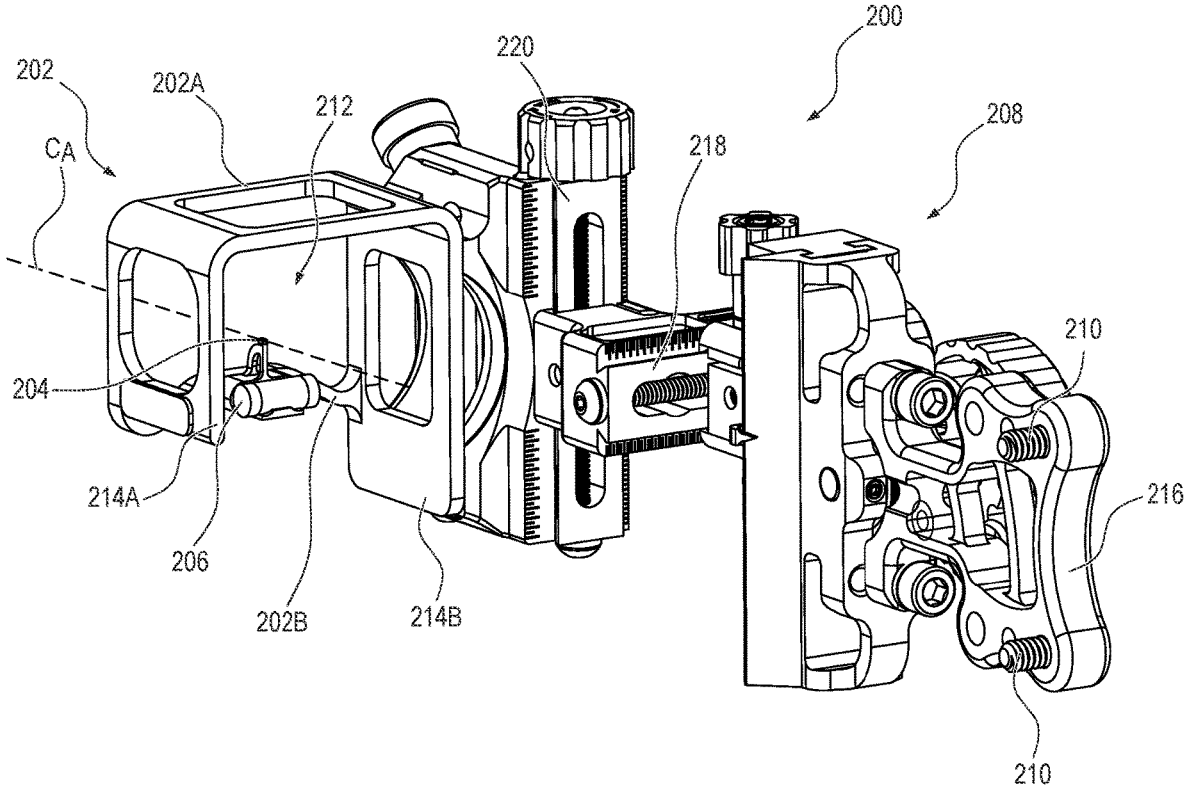
FIG. 2A is a perspective side view of an archery bow sight, according to some embodiments.
Figure 2B:
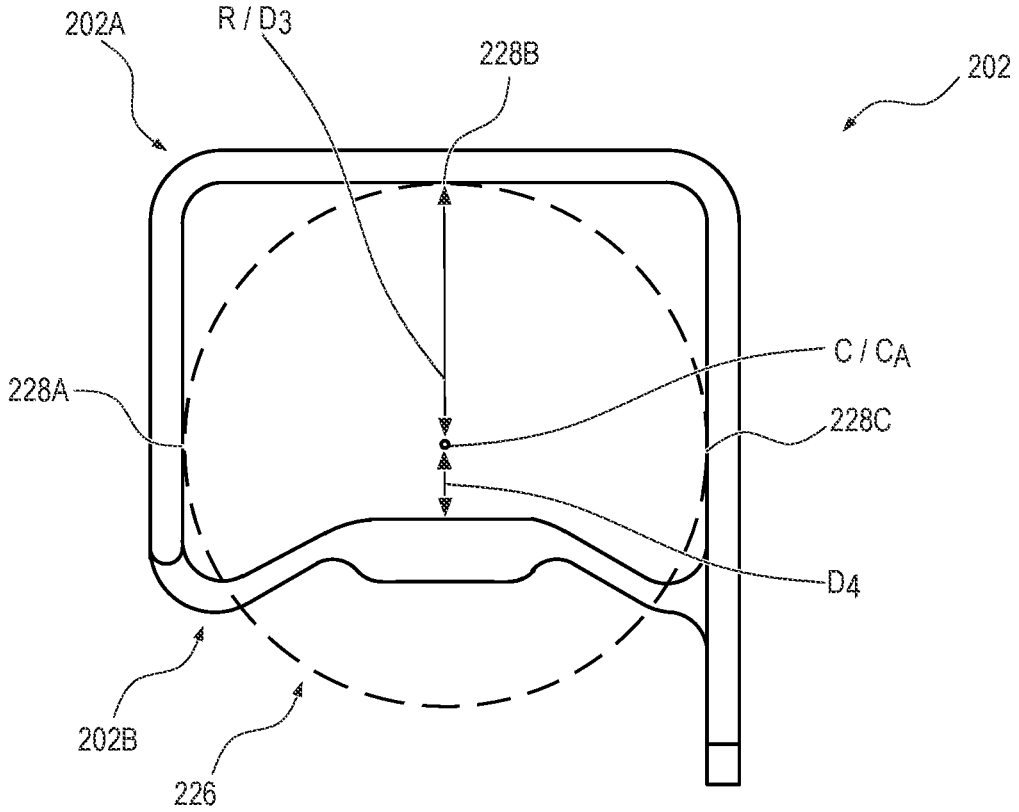
FIG. 2B is a rear view of a housing of the archery bow sight, according to some embodiments.
Figure 2C:
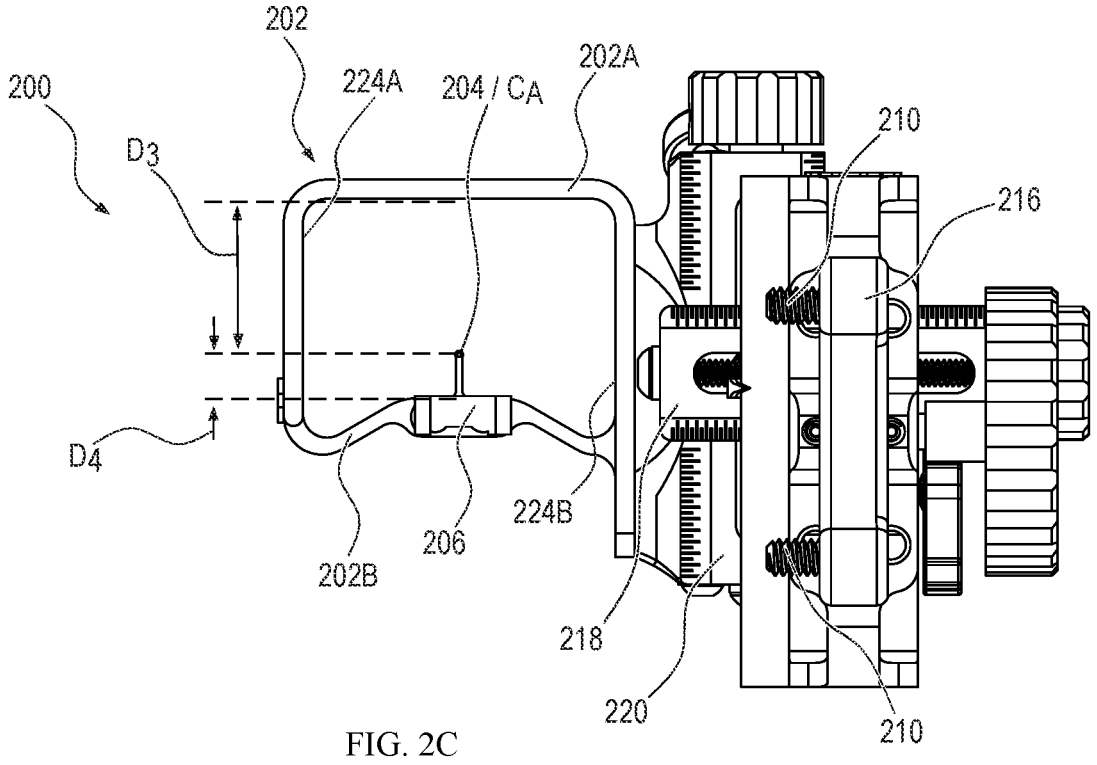
FIG. 2C is a rear view of the archery bow sight, according to some embodiments.

FIGS. 2A-2C show another example of an archery bow sight 200 according to aspects of the present disclosure. The archery bow sight 200 can include a housing 202, one or more pins 204, a level indicator 206, and a support structure 208. The one or more pins 204, the level indicator 206, and the support structure 208 can be substantially similar to, and can include some or all of, the features of the respective one or more pins 104, the level indicator 106, and the support structure 108 shown in FIGS. 1A-1E. For example, the support structure 208 can include a mounting block 216, a windage block 218, and an elevation block 220. The sight 200 can be coupled to an archery bow, for example, by coupling the sight 200 to a riser of an archery bow via fasteners 210. In some examples, the support structure 208 can include one or more components configured to mount to a picatinny rail.

The housing 202 can include can include a first section 202A and a second section 202B. The first section 202A can form a cavity or volume 212 at least partially surrounding the one or more pins 204. In some examples, the first section 202A can include first and second distal ends 214A, 214B gapped or separated from one another by a distance. The first section 202A and the second section 202B can be integrally formed or otherwise coupled together, for example, with one or more fasteners or adhesive. In some examples, the housing 202 can have a cross-sectional shape that is rectangular or square. In some examples, such as the example shown in FIGS. 1A-1E, the housing can have a cross-sectional shape that is oval, circular, or semicircular. In some examples, the second section 202B can be disposed between at least a portion of the first section 202A and a projectile (e.g., an arrow) when the sight 200 is coupled to an archery bow and the projectile is launched from the archery bow. In some examples, at least a portion of the first section 202A can be disposed at a relatively higher elevation than the second section 202B when the projectile is launched from the archery bow.

As shown in FIG. 2B, in some examples, a projected shape 226 can be defined, drawn, characterized, formed, or otherwise visualized within the first section 202A. For example, the projected shape 226 can be a circle having a constant radius R with a first, a second, and a third tangent point 228A, 228B, 228C at the first section 202A. The projected shape 226 can be corradial with one or more surfaces of the first section 202A. The first, second, and third tangent points 228A, 228B, 228C can be respective points at which the projected shape 226 touches one or more inner-facing surfaces of the first section 202A (e.g., lateral inner surfaces 224A, 224B). In some examples, the first, second, and third tangent points 228A, 228B, 228C can intersect one or more of the inner-facing surfaces of the first section 202A. In some examples, the first, second, and third tangent points 228A, 228B, 228C may not intersect one or more of the inner-facing surfaces of the first section 202A. In some examples, the projected shape 226 can define a center C and a central axis $C_A$ extending axially or longitudinally through the housing 202 and intersecting the center C. In some examples, the central axis $C_A$ can extend through the volume 212 and can be disposed equidistant from the respective lateral inner surfaces 224A, 224B of the first section 202A. In some examples. The projected shape 226 can intersect the second section 202B. For example. The projected shape 226 can be defined, drawn, characterized, formed, or otherwise visualized to extend beyond the first section 202A and at least partially overlapping with the second section 202B.

As shown in FIGS. 2B and 2C the first section 202A can be disposed a minimum distance $D_3$ (e.g., constant radius R) from the center C. The second section 202B can be disposed a minimum distance $D_4$ from the central axis $C_A$. The minimum distance $D_3$ is greater than the minimum distance $D_4$. For example, the minimum distance $D_3$ can be 1.5 times greater than the minimum distance $D_4$. In some examples, the minimum distance $D_3$ and the minimum distance $D_4$ can form a ratio of less than 1.25 to 1, between about 1.25 to 1 and about 1.5 to 1, between about 1.5 to 1 and about 1.75 to 1, between about 1.75 to 1 and about 2 to 1, between about 2 to 1 and about 2.25 to 1, between about 2.25 to 1 and about 2.5 to 1, or greater than 2.5 to 1. While the pin 204, the center C, and the central axis $C_A$ are shown as aligned or substantially aligned in FIG. 2C, the pin 204 may not be aligned with the center C and the central axis $C_A$ in some examples. In other words, the pin 204 may not be disposed the minimum distance $D_3$ (e.g., the constant radius R) from the first section 202A in some examples. Instead, the pin 204 can be disposed a distance greater than or less than the minimum distance $D_3$ from the first section 202A in some examples.

Figure 3A:
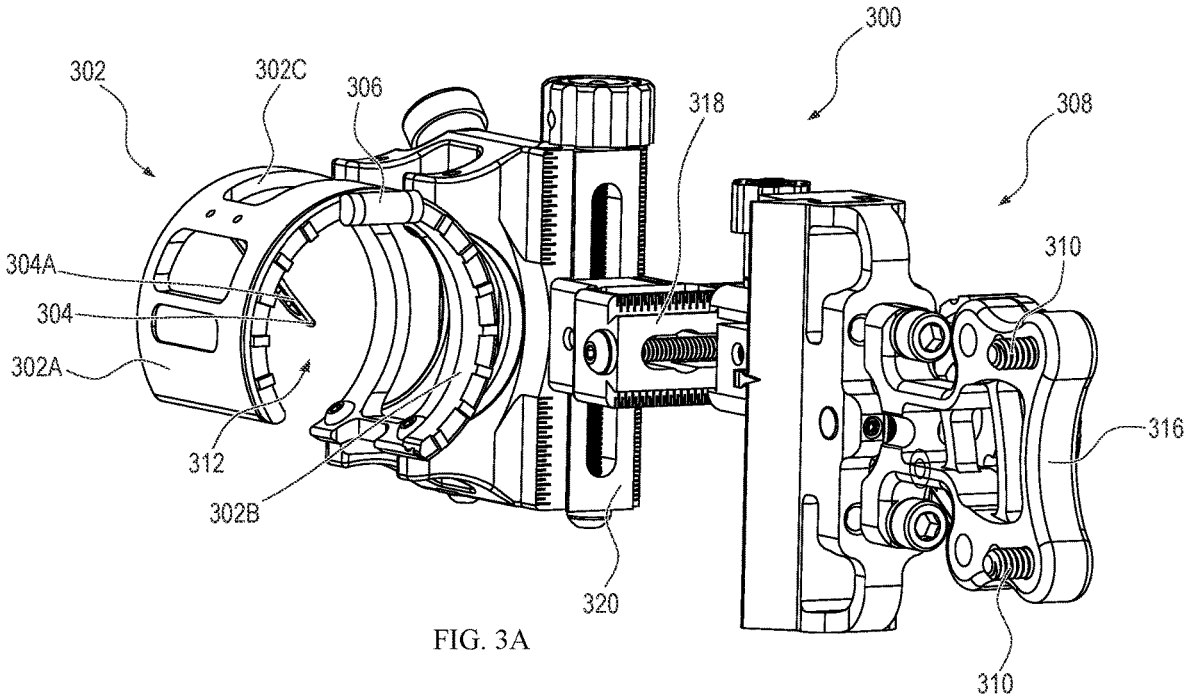
FIG. 3A is a perspective side view of an archery bow sight, according to some embodiments.
Figure 3B:
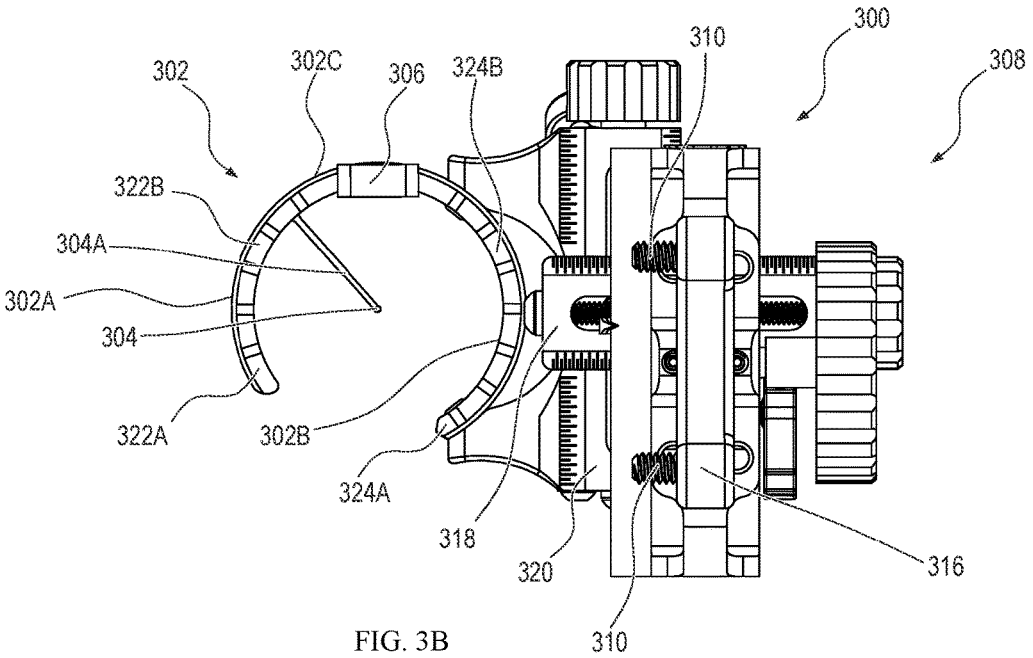
FIG. 3B is a rear view of the archery bow sight, according to some embodiments.

FIGS. 3A and 3B show another example of an archery bow sight 300 according to aspects of the present disclosure. The archery bow sight 300 can include a housing 302, one or more pins 304, a level indicator 306, and a support structure 308. The one or more pins 304, the level indicator 306, and the support structure 308 can be substantially similar to, and can include some or all of, the features of the respective one or more pins 104, the level indicator 106, and the support structure 108 shown in FIGS. 1A-1E. For example, the support structure 308 can include a mounting block 316, a windage block 318, and an elevation block 320. The sight 300 can be coupled to an archery bow, for example, by coupling the sight 300 to a riser of an archery bow via fasteners 310. In some examples, the support structure 308 can include one or more components configured to mount to a picatinny rail.

In some examples, the housing 302 includes a first lateral wall or section 302A, a second lateral wall or section 302B, and an intermediate section 302C. The intermediate section 302C is disposed between the first lateral section 302A and the second lateral section 302B. The first lateral section 302A includes a first distal end 322A and a first proximal end 322B. The second lateral section 302B includes a second distal end 324A and a second proximal end 324B. The first distal end 322A can be distanced or spaced apart from the second distal end 324A. The first distal end 322A can be free-floating or otherwise unsupported and uncoupled to any other component of the sight 300 other than the first lateral section 302A of the housing 302. Additionally, or alternatively, the second distal end 324A can be free-floating or otherwise unsupported and uncoupled to any other component of the sight 300 other than the second lateral section 302B of the housing 302. A void or gap can be defined first and second distal ends 322A, 324A such that the one or more pins 304 can be disposed adjacent or within a relatively close proximity to a projectile (see arrow 326 at FIG. 3C) launched from the archery bow. While the first lateral section 302A, the second lateral section 302B, and the intermediate section 302C are shown as integrally formed sections in FIGS. 3A-3D, the first lateral section 302A, the second lateral section 302B, and the intermediate section 302C can be distinct or separable sections in other examples.

Additionally, or alternatively, the housing 302 can be defined as simply including first and second lateral sections 302A, 302B or halves of the housing 302. That is, the housing 302 can be interpreted to only include the first and second lateral sections 302A, 302B which are directly coupled or connected to one another without the intermediate section 302C. For example, the housing 302 can be defined as two halves (e.g., the first and second lateral sections 302A, 302B) disposed on opposing sides of a vertical place bisecting the housing 302. Each respective half can be integrally formed and have respective distal ends 322A, 324A.

In some examples, the first, the second, and the intermediate sections 302A, 302B, 302C can partially define a volume 312. One or more of the first, the second, or the intermediate sections 302A, 302B, 302C can act as a support for the pin 304 and/or the level indicator 306. For example, the level indicator 306 can be fastened, adhered, a combination thereof, or otherwise coupled to the intermediate section 302C. The one or more pins 304 can be fastened, adhered, a combination thereof, or otherwise coupled to one or more of the first, the second, and the intermediate sections 302A, 302B, 302C. For example, the pin 304 is depicted as extending from differing sections (e.g., the first lateral section 302A and the intermediate section 302C) in FIGS. 3A-3B and FIGS. 3C-3D. In some examples, the pin 304 can include a pin support 304A retaining a fiberoptic element. In other examples, the pin 304 can be an indicia (e.g., a printed or etched dot) disposed on a transparent lens (not shown) coupled to the housing 302 within the volume 312.

Figure 3C:
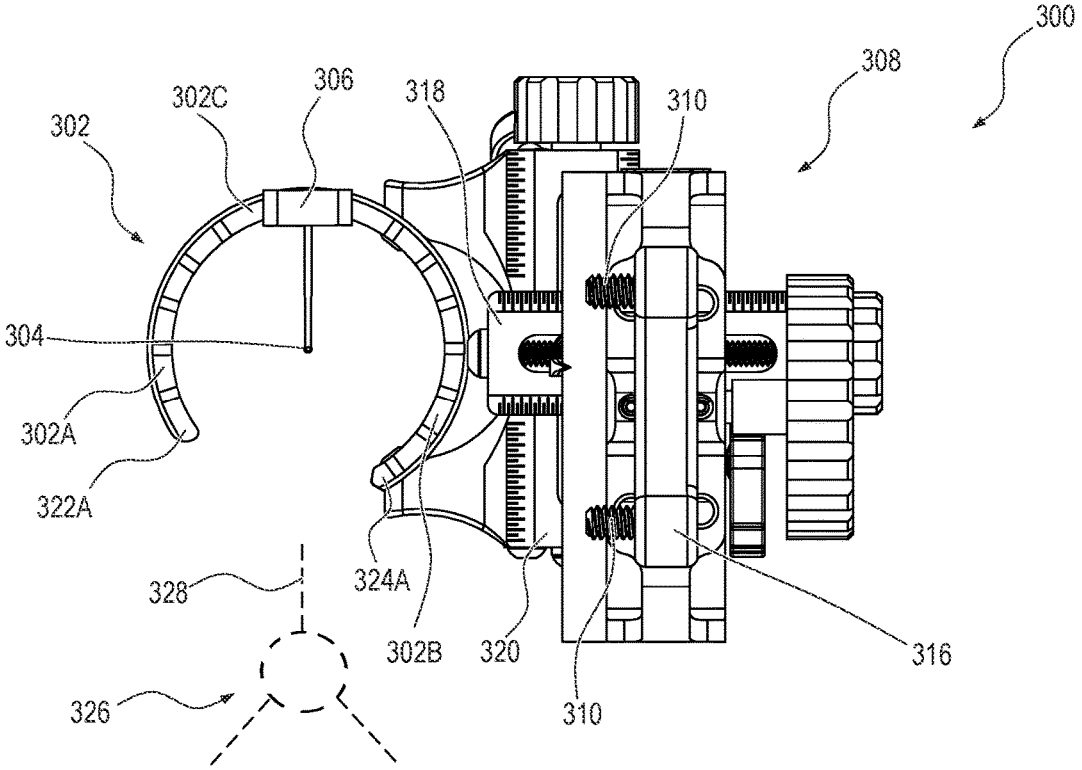
FIG. 3C is a rear view of the archery bow sight in a first configuration, according to some embodiments.
Figure 3D:
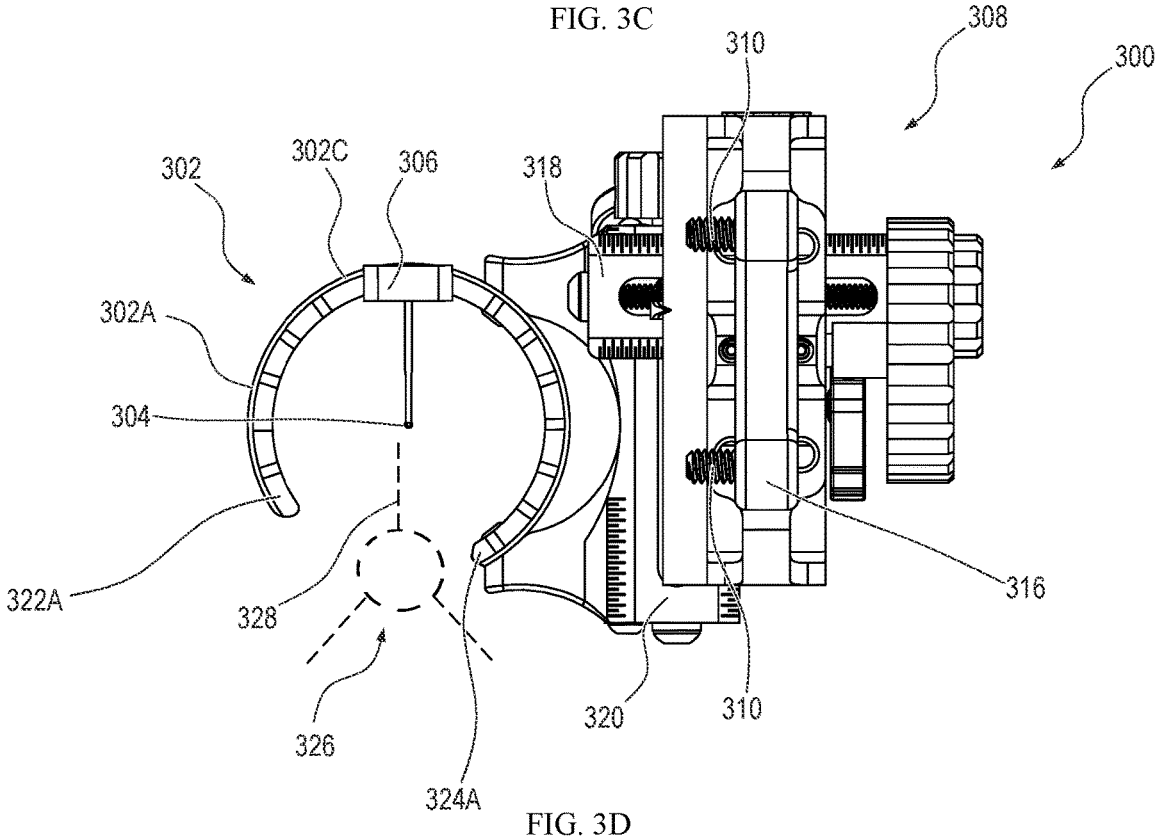
FIG. 3D is a rear view of the archery bow sight in a second configuration, according to some embodiments.

While the pin support 304A is shown as extending from the first lateral section 302A in FIGS. 3A and 3B, the pin support 304A can additionally, or alternatively, extend from one or more of the first, second, and intermediate sections 302A, 302B, 302C as shown in FIGS. 3C and 3D. FIGS. 3C and 3D also illustrate a range of adjustment of the housing 302 wherein the pin 304 within the housing 302 can be disposed or translated relatively closer to an arrow 326 than traditional archery bow sights. In other words, the housing 302 can be sized and shaped (e.g., missing or lacking a lower housing section) to enable the pin 304 within the housing 302 to be translated closer to the arrow 326 thereby enabling the archer to utilize the pin 300 to reliably aim at greater distances than supported by traditional archery bow sights. In some examples, the housing 302 can be translated such that at least a portion of the arrow 326, such as a vane 328, can be disposed between the respective first and second distal ends 322A, 324A of the first and second lateral sections 302A, 302B.

Figure 4A:
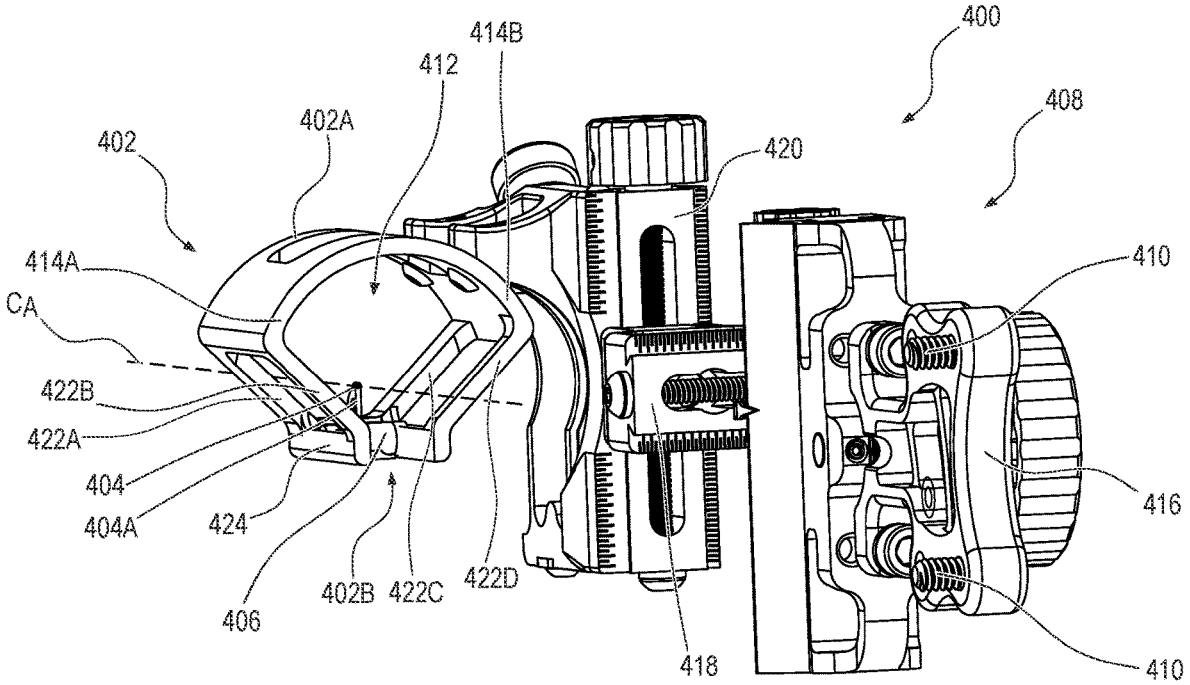
FIG. 4A is a perspective side view of an archery bow sight, according to some embodiments.
Figure 4B:
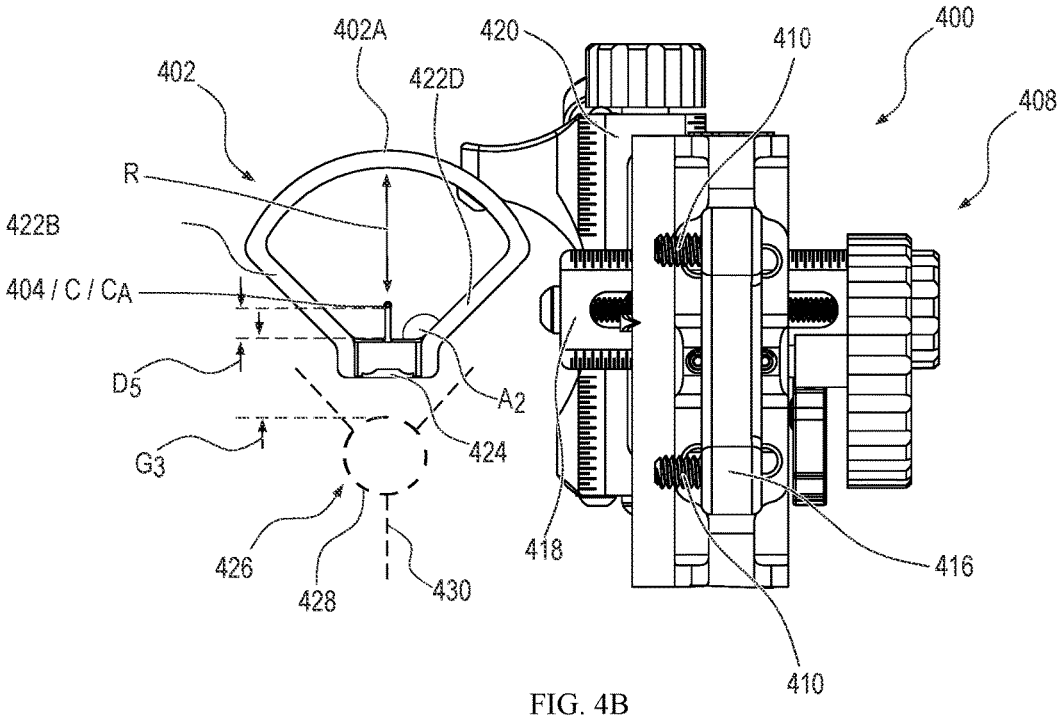
FIG. 4B is a rear view of the archery bow sight, according to some embodiments.

FIGS. 4A and 4B show an archery bow sight 400 according to aspects of the present disclosure. The archery bow sight 400 can include a housing 402, one or more pins 404, a level indicator 406, and a support structure 408. The one or more pins 404, the level indicator 406, and the support structure 408 can be substantially similar to, and can include some or all of, the features of the respective one or more pins 104, the level indicator 106, and the support structure 108 shown in FIGS. 1A-1E. For example, the support structure 408 can include a mounting block 416, a windage block 418, and an elevation block 420. The sight 400 can be coupled to an archery bow, for example, by coupling the sight 400 to a riser of an archery bow via fasteners 410. In some examples, the support structure 408 can include one or more components configured to mount to a picatinny rail.

In some examples, the housing 402 can include a first section 402A and a second section 402B. The first section 402A and the second section 402B can be integrally formed in some examples. In other words, the first section 402A and the second section 402B can be molded or machined from a single piece of material. In some examples, the first section 402A can be coupled to the second section 402B, for example, by one or more fasteners, adhesives, welds, a combination thereof, or any other coupling mechanism. The first section 402A can form a cavity or volume 412 at least partially surrounding the one or more pins 404. In some examples, the first section 402A can include first and second distal ends 414A, 414B gapped or separated from one another by a distance. In some examples, the second section 402B can be disposed between the first section 402A and a projectile (see arrow 426 at FIG. 4B) when the sight 100 is coupled to an archery bow, for example, the first section 402A can be disposed at a relatively higher elevation than the second section 402B when the projectile is launched from the archery bow.

In some examples, at least a portion of the first section 402A can have a constant curvature (e.g., constant radius of curvature) defining a radius R to a center C of the of curvature (e.g., the focus of the curvature). In some examples, a pin (e.g., the one or more pins 404) can be disposed at the center C (e.g., disposed the radius R from the first section 402A). Additionally, or alternatively, one or more pins (e.g., the one or more pins 404) can be disposed below the center C (e.g., disposed further from the first section 402A than the radius R). Additionally, or alternatively, one or more pins (e.g., the one or more pins 404) can be disposed above the center C (e.g., disposed nearer the first section 402A than the radius R). The center C can define a central axis $C_A$ extending through volume 412. In other words, the first section 402A can define the central axis $C_A$ intersecting and extending along the center C.

As shown in FIG. 4B the first section 402A can be disposed the radius R from the central axis $C_A$. The second section 402B can be disposed a minimum distance $D_5$ from the central axis $C_A$. The radius R is greater than the minimum distance $D_5$. For example, the radius R can be 1.5 times greater than the minimum distance $D_5$. In some examples, the radius R and the minimum distance $D_5$ can form a ratio of less than 1.25 to 1, between about 1.25 to 1 and about 1.5 to 1, between about 1.5 to 1 and about 1.75 to 1, between about 1.75 to 1 and about 2 to 1, between about 2 to 1 and about 2.25 to 1, between about 2.25 to 1 and about 2.5 to 1, or greater than 2.5 to 1. While the pin 404 and the center C of the curvature of the first section 402A are shown as aligned or substantially aligned in FIG. 4B, the pin 404 may not be aligned with the center C in some examples. In other words, the pin 404 may not be disposed the radius R from the first section 402A in some examples. Instead, the pin 104 can be disposed a distance greater than or less than the radius R from the first section 402A in some examples.

In some examples, the second section 402B can partially define the volume 412. The second section 402B can act as a support for the pin 404 and/or the level indicator 406. For example, the level indicator 406 can be fastened, adhered, a combination thereof, or otherwise coupled to the second section 402B. In some examples, the pin 404 can include a pin support 404A retaining a fiberoptic element. In other examples, the pin 404 can be an indicia (e.g., a printed or etched dot) disposed on a transparent lens (not shown) coupled to the housing 402 within the volume 412. In some examples, the second section 402B can include one or more members 422A-422D extending from the first section 402A and coupled to a base 424 supporting the one or more pins 404 and the level indicator 406.

As shown in FIG. 4B, the members 422A-422D can be arranged to enable the housing 402 to be disposed near an arrow 426 (see gap $G_3$). More specifically, the members 422A-422D can be arranged such that the housing 402 can be disposed near an arrow shaft 428 of the arrow 426 and also provides clearance for one or more vanes 430 of the arrow 426. For example, each of the one or more members 422A-422D can be angled (see angle $A_2$) relative to the base 424. The angle $A_2$ can be at least 90 degrees, between about 90 degrees and about 135 degrees, between about 135 degrees and about 180 degrees, between about 180 degrees and about 225 degrees, or greater than 225 degrees.

In some examples, changes may be made in the function and arrangement of archery components or products discussed without departing from the spirit and scope of the disclosure, and various embodiments may omit, substitute, or add other components or accessories as appropriate. For instance, one or more sections incorporated into a particular component described with respect to certain embodiments may be combined in other embodiments.

Various aspects have been described herein with reference to certain specific embodiments and examples. However, they will be recognized by those skilled in the art that many variations are possible without departing from the scope and spirit of the inventions disclosed herein, in that those inventions set forth in the claims below are intended to cover all variations and modifications of the inventions disclosed without departing from the spirit of the inventions. The terms "including:" and "having" come as used in the specification and claims shall have the same meaning as the term "comprising."

What is claimed:

1. A sight for an archery bow, comprising:

a housing having a first section and a second section, the first section defining a constant curvature about a radius and a center, the center defining an axis intersecting the center, wherein the radius is at least 1.5 times greater than a minimum distance from the second section to the axis, the second section having a base and a support member, the support member extending from the first section to the base, the base and the support member defining an angle greater than 90 degrees, the base and the support member arranged to dispose the base adjacent a projectile path;

a pin disposed within the housing; and a level indicator coupled to the housing.

2. The sight of claim 1, wherein a cross-section of the first section defines a semicircle.

3. The sight of claim 1, wherein a portion of the second section extends toward the axis.

4. The sight of claim 1, wherein the base is disposed nearer to the axis than the support member such that the support member is disposed further from the axis than the base is disposed from the axis.

5. The sight of claim 1, wherein the radius is at least 2 times greater than the minimum distance from the second section to the axis.

6. The sight of claim 1, wherein the first section and the second section are integrally formed.

7. The sight of claim 1, wherein the pin is coupled to the base.

8. The sight of claim 1, wherein the level indicator is coupled to the second section.

9. A sight for an archery bow, comprising:

a housing having a first section and a second section, the first section defining a projected shape having three tangent points on the first section, the projected shape having a constant radius and defining a center, the projected shape intersecting the second section, a central axis extending axially through the center, wherein a minimum distance from the first section to the central axis is at least 1.5 times greater than a minimum distance from the second section to the central axis, the second section having a base and a support member, the support member interconnecting the base and the first section, the base and the support member arranged to dispose a projectile path within the projected shape;

a pin disposed within the housing; and a level indicator coupled to the housing.

10. The sight of claim 9, wherein the central axis is defined equidistant from respective lateral inner surfaces of the first section.

11. The sight of claim 9, wherein the minimum distance from the first section to the central axis is at least 2 times greater than the minimum distance from the second section to the central axis.

12. The sight of claim 9, wherein the central axis is disposed nearer to the level indicator than the first section.

13. The sight of claim 9, wherein the first section has a semi-circular cross-sectional shape.

14. A sight for an archery bow, comprising:

a housing comprising:

a first lateral section having a first distal end; and a second lateral section having a second distal end, the first distal end being displaced a distance from the second distal end, wherein at least one of the first distal end and the second distal end are free-floating;

a pin disposed within the housing; and a level indicator coupled to the housing.

15. The sight of claim 14, wherein the housing further comprises an intermediate section coupled to a first proximal end of the first lateral section and a second proximal end of the second lateral section.

16. The sight of claim 15, wherein the first lateral section, the second lateral section, and the intermediate section are integrally formed.

17. The sight of claim 14, wherein the pin is disposed on a support extending from the housing.

18. The sight of claim 14, further comprising a transparent lens coupled to the housing, wherein the pin is disposed on the transparent lens.

19. The sight of claim 14, wherein the housing defines a central axis, the central axis intersecting the pin.

* * * * *